US008347522B2

(12) United States Patent
Dyson et al.

(10) Patent No.: US 8,347,522 B2
(45) Date of Patent: Jan. 8, 2013

(54) DRYING APPARATUS

(75) Inventors: James Dyson, Gloucestershire (GB); Peter David Gammack, Wiltshire (GB)

(73) Assignee: Dyson Technology Limited, Malmesbury (GB)

( * ) Notice: Subject to any disclaimer, the term of this patent is extended or adjusted under 35 U.S.C. 154(b) by 1160 days.

(21) Appl. No.: 11/997,308

(22) PCT Filed: Jun. 26, 2006

(86) PCT No.: PCT/GB2006/002347

§ 371 (c)(1),
(2), (4) Date: Jun. 6, 2008

(87) PCT Pub. No.: WO2007/015046

PCT Pub. Date: Feb. 8, 2007

(65) Prior Publication Data

US 2008/0313918 A1 Dec. 25, 2008

(30) Foreign Application Priority Data

Jul. 30, 2005 (GB) ..... 0515749.0
Jan. 17, 2006 (GB) ..... 0600879.1

(51) Int. Cl.
*F26B 19/00* (2006.01)

(52) U.S. Cl. ..... 34/90; 34/104; 392/381

(58) Field of Classification Search ..... 34/90, 80, 34/137, 104, 105, 202, 210, 218; 392/380, 392/381, 384; 4/626; 165/201; 68/3 R, 68/38; 2/16; 134/26

See application file for complete search history.

(56) References Cited

U.S. PATENT DOCUMENTS

| | | | |
|---|---|---|---|
| 16,110 | A | 11/1856 | Baldwin |
| 1,258,633 | A | 3/1918 | Heath |
| 1,500,094 | A | 7/1924 | Kee |
| 1,598,660 | A | 9/1926 | Sieben |
| 1,658,489 | A | 2/1928 | Lindstrom |
| 1,688,793 | A | 10/1928 | Schrenkeisen |
| 1,693,308 | A | 11/1928 | Merkowitz |
| 1,704,136 | A | 3/1929 | Lemp |

(Continued)

FOREIGN PATENT DOCUMENTS

| | | |
|---|---|---|
| CA | 1124057 | 5/1982 |

(Continued)

OTHER PUBLICATIONS

International Search Report dated Aug. 25, 2006, directed to counterpart application No. PCT/GB2006/002347. (5 pages).

(Continued)

*Primary Examiner* — Stephen M. Gravini
(74) *Attorney, Agent, or Firm* — Morrison & Foerster LLP

(57) ABSTRACT

A drying apparatus has a casing, a cavity formed in the casing for receiving an object, a fan located in the casing and creating an airflow, a motor arranged to drive the fan. At least one opening communicates with the fan and is arranged in the casing so as to direct an airflow transversely across the cavity. The motor and fan arrangement generate an airflow across the cavity, wherein, in use, the pressure of the airflow emitted through the opening is at least 8 kPa. The motor has a rotor which, in use, may rotate at a speed of at least 80,000 rpm. The high velocity, high pressure airflow provided by the apparatus is capable of drying an object efficiently and quickly and is suitable for use in a hand dryer.

11 Claims, 7 Drawing Sheets

U.S. PATENT DOCUMENTS

| | | | | | |
|---|---|---|---|---|---|
| 1,830,323 | A | | 11/1931 | Judelson et al. | |
| 2,013,572 | A | | 9/1935 | McCord | |
| 2,104,135 | A | | 1/1938 | Morrill | |
| 2,109,028 | A | | 2/1938 | Miller | |
| 2,109,704 | A | | 3/1938 | Morrill | |
| 2,111,148 | A | | 3/1938 | Judelson | |
| 2,134,493 | A | | 10/1938 | Uroukoff | |
| 2,188,506 | A | | 1/1940 | Hall | |
| 2,260,558 | A | | 10/1941 | Caughey et al. | |
| 2,267,158 | A | | 12/1941 | Locke | |
| 2,278,574 | A | | 4/1942 | Spohr et al. | |
| 2,287,795 | A | | 6/1942 | Hall | |
| 2,385,962 | A | | 10/1945 | Barnett | |
| 2,452,858 | A | | 11/1948 | Miller | |
| 2,479,387 | A | | 8/1949 | Matthews et al. | |
| 2,550,118 | A | | 4/1951 | Kauffman, II | |
| 2,645,032 | A | | 7/1953 | Hammell | |
| 2,911,732 | A | | 11/1959 | Webb | |
| 3,009,188 | A | | 11/1961 | Martin | |
| 3,071,801 | A | | 1/1963 | Scheiding | |
| 3,091,955 | A | | 6/1963 | Taylor et al. | |
| 3,096,702 | A | | 7/1963 | Malone, Sr. et al. | |
| 3,180,239 | A | | 4/1965 | Shearer et al. | |
| 3,233,339 | A | | 2/1966 | Long et al. | |
| 3,258,853 | A | | 7/1966 | Bradbury | |
| 3,312,160 | A | | 4/1967 | Rackley | |
| 3,321,844 | A | | 5/1967 | Seedorf | |
| 3,375,593 | A | | 4/1968 | Fleisher et al. | |
| 3,383,700 | A | | 5/1968 | Taylor | |
| 3,437,030 | A | | 4/1969 | Mastrosimone et al. | |
| 3,448,497 | A | | 6/1969 | Arnold et al. | |
| 3,464,388 | A | | 9/1969 | Stout | |
| 3,526,946 | A | | 9/1970 | Palmer | |
| 3,603,002 | A | | 9/1971 | Spierer | |
| 3,610,881 | A | | 10/1971 | Stewart | |
| 3,612,824 | A | | 10/1971 | Berryman | |
| 3,643,346 | A | | 2/1972 | Lester | |
| 3,667,134 | A | | 6/1972 | Rockson | |
| 3,670,718 | A | | 6/1972 | Brendgord | |
| 3,721,026 | A | | 3/1973 | McCallum | |
| 3,744,149 | A | | 7/1973 | Helbling | |
| 3,748,746 | A | | 7/1973 | Robandt | |
| 3,752,059 | A | | 8/1973 | Boyer | |
| 3,758,799 | A | | 9/1973 | Dochterman et al. | |
| 3,766,397 | A | | 10/1973 | Rockson | |
| 3,785,523 | A | | 1/1974 | Goldstein | |
| 3,797,752 | A | | 3/1974 | Cercone | |
| 3,814,898 | A | * | 6/1974 | Levine | 392/404 |
| 3,826,607 | A | | 7/1974 | Kuhn | |
| 3,854,219 | A | | 12/1974 | Staats | |
| 3,874,073 | A | | 4/1975 | Dochterman et al. | |
| 3,952,867 | A | | 4/1976 | McCord | |
| 4,015,366 | A | | 4/1977 | Hall, III | |
| 4,039,774 | A | | 8/1977 | Kata et al. | |
| 4,047,692 | A | | 9/1977 | Swin, Sr. | |
| 4,085,522 | A | | 4/1978 | Stroszynski | |
| 4,087,925 | A | | 5/1978 | Bienek | |
| 4,091,762 | A | | 5/1978 | Ruehl | |
| 4,107,257 | A | | 8/1978 | Swin, Sr. | |
| 4,144,596 | A | | 3/1979 | MacFarlane et al. | |
| 4,145,769 | A | | 3/1979 | MacFarlane et al. | |
| 4,188,732 | A | | 2/1980 | Quayle | |
| 4,195,419 | A | | 4/1980 | Quayle | |
| 4,205,460 | A | | 6/1980 | Taylor | |
| 4,220,846 | A | | 9/1980 | Rice et al. | |
| 4,250,631 | A | * | 2/1981 | Moses | 34/104 |
| 4,267,643 | A | | 5/1981 | Haried | |
| 4,278,223 | A | | 7/1981 | Fauteux | |
| 4,295,233 | A | | 10/1981 | Hinkel et al. | |
| 4,310,747 | A | | 1/1982 | Rice et al. | |
| 4,312,139 | A | | 1/1982 | Preisler et al. | |
| 4,313,787 | A | | 2/1982 | Ciboit et al. | |
| 4,334,350 | A | | 6/1982 | Rice et al. | |
| RE31,023 | E | | 9/1982 | Hall, III | |
| 4,383,377 | A | | 5/1983 | Crafton | |
| 4,389,562 | A | | 6/1983 | Chaudoir | |
| 4,398,310 | A | | 8/1983 | Lienhard | |
| 4,489,507 | A | * | 12/1984 | Kawai | 34/77 |
| 4,495,086 | A | | 1/1985 | Hiroshima et al. | |
| 4,497,999 | A | | 2/1985 | Postbeschild | |
| 4,564,956 | A | | 1/1986 | DiBuono | |
| 4,600,128 | A | | 7/1986 | Rohrer | |
| 4,625,432 | A | | 12/1986 | Baltes | |
| 4,629,864 | A | * | 12/1986 | Wilson | 392/385 |
| 4,665,630 | A | | 5/1987 | Postbeschild | |
| 4,677,764 | A | | 7/1987 | Cerny | |
| 4,704,806 | A | | 11/1987 | Gresens | |
| 4,734,017 | A | | 3/1988 | Levin | |
| 4,754,607 | A | | 7/1988 | Mackay | |
| 4,802,287 | A | | 2/1989 | Chen | |
| 4,809,444 | A | | 3/1989 | Henderson et al. | |
| 4,826,262 | A | | 5/1989 | Hartman et al. | |
| 4,843,653 | A | | 7/1989 | Coble | |
| 4,857,705 | A | | 8/1989 | Blevins | |
| 4,876,435 | A | | 10/1989 | Hawkins | |
| 4,908,959 | A | | 3/1990 | Kretchman et al. | |
| 4,914,833 | A | | 4/1990 | Pilolla et al. | |
| 4,928,402 | A | * | 5/1990 | Allen | 34/97 |
| 4,941,521 | A | | 7/1990 | Redekop et al. | |
| 4,952,432 | A | | 8/1990 | Ten Wolde | |
| 4,986,681 | A | | 1/1991 | Oliver | |
| 4,991,314 | A | * | 2/1991 | Allen | 34/98 |
| 4,993,172 | A | | 2/1991 | Allen | |
| 5,031,337 | A | | 7/1991 | Pilolla et al. | |
| 5,047,351 | A | | 9/1991 | Makiuchi et al. | |
| 5,064,154 | A | | 11/1991 | Payne | |
| 5,074,322 | A | | 12/1991 | Jaw | |
| 5,107,603 | A | | 4/1992 | Durazzani | |
| 5,111,594 | A | | 5/1992 | Allen | |
| 5,146,695 | A | | 9/1992 | Yang | |
| 5,152,852 | A | | 10/1992 | Hisamichi et al. | |
| 5,168,621 | A | | 12/1992 | Kruck et al. | |
| 5,186,360 | A | | 2/1993 | Mease et al. | |
| 5,249,370 | A | | 10/1993 | Stanger et al. | |
| 5,253,373 | A | | 10/1993 | Tsipov | |
| 5,280,679 | A | | 1/1994 | Edelman | |
| 5,318,754 | A | * | 6/1994 | Collins et al. | 422/109 |
| 5,320,627 | A | | 6/1994 | Sorensen et al. | |
| 5,374,118 | A | | 12/1994 | Kruck et al. | |
| 5,377,427 | A | | 1/1995 | Mashata | |
| 5,379,483 | A | | 1/1995 | Pino | |
| 5,379,525 | A | | 1/1995 | Raynor | |
| 5,397,028 | A | | 3/1995 | Jesadanont | |
| 5,406,718 | A | * | 4/1995 | Stein | 34/362 |
| 5,407,354 | A | | 4/1995 | Fife | |
| 5,407,723 | A | | 4/1995 | Curtin | |
| 5,423,249 | A | | 6/1995 | Meyer | |
| 5,436,092 | A | | 7/1995 | Ohtsuka et al. | |
| 5,459,944 | A | | 10/1995 | Tatsutani et al. | |
| 5,522,411 | A | | 6/1996 | Johnson | |
| 5,545,451 | A | | 8/1996 | Haung et al. | |
| 5,546,678 | A | | 8/1996 | Dhaemers | |
| 5,555,640 | A | | 9/1996 | Ou | |
| 5,601,870 | A | | 2/1997 | Haung et al. | |
| 5,612,083 | A | | 3/1997 | Haung et al. | |
| 5,620,249 | A | * | 4/1997 | Musil | 366/25 |
| 5,636,815 | A | | 6/1997 | Wilson | |
| 5,755,040 | A | | 5/1998 | Ou | |
| 5,870,836 | A | | 2/1999 | Grimes | |
| 5,873,178 | A | | 2/1999 | Johnson | |
| 5,875,562 | A | * | 3/1999 | Fogarty | 34/97 |
| 5,882,743 | A | | 3/1999 | McConnell | |
| 5,901,462 | A | | 5/1999 | Rudd | |
| 5,945,068 | A | | 8/1999 | Ferone | |
| 5,972,474 | A | | 10/1999 | Tsuzuki et al. | |
| 5,974,685 | A | | 11/1999 | Hironaka | |
| 5,987,773 | A | | 11/1999 | Lipscy | |
| 6,005,227 | A | | 12/1999 | Pappas | |
| 6,038,786 | A | | 3/2000 | Aisenberg et al. | |
| 6,047,485 | A | | 4/2000 | Madyun | |
| 6,050,000 | A | | 4/2000 | Curzon | |
| 6,050,275 | A | | 4/2000 | Kamikawa et al. | |
| 6,085,442 | A | | 7/2000 | Erickson | |
| 6,104,302 | A | | 8/2000 | Vuong | |
| 6,119,361 | A | | 9/2000 | Baker | |
| 6,119,437 | A | | 9/2000 | Baker | |
| 6,131,588 | A | | 10/2000 | Kamikawa et al. | |

6,137,067 A 10/2000 Helms et al.
6,158,673 A 12/2000 Toetschinger et al.
6,185,838 B1 2/2001 Moore
6,206,980 B1 3/2001 Robinson
6,256,903 B1 7/2001 Rudd
6,263,591 B1 7/2001 La Porte
6,279,836 B1 8/2001 Toetschinger et al.
6,280,092 B1 8/2001 Backus et al.
6,282,812 B1 * 9/2001 Wee et al. ..... 34/464
6,295,410 B1 9/2001 Helms et al.
6,298,777 B1 10/2001 Dubois et al.
6,342,104 B1 1/2002 Kamikawa et al.
6,431,189 B1 8/2002 Deibert
6,431,217 B2 8/2002 Robinson
6,606,801 B2 8/2003 Strang et al.
6,620,504 B2 9/2003 Mizumura et al.
6,624,606 B2 9/2003 Kushida et al.
6,651,357 B2 11/2003 Bria et al.
6,681,497 B2 1/2004 Bria et al.
6,684,648 B2 2/2004 Faqih
6,705,107 B2 3/2004 Schlosser et al.
6,732,858 B1 5/2004 Chang Ou
6,746,543 B2 6/2004 Kamikawa et al.
6,749,148 B2 6/2004 Helfer-Grand
6,766,589 B1 7/2004 Bory et al.
6,769,197 B1 8/2004 Tai
6,793,851 B1 9/2004 Bompay et al.
6,845,569 B1 1/2005 Kim
6,860,032 B2 3/2005 Meyer
6,892,475 B2 5/2005 Wakamatsu et al.
6,914,341 B1 7/2005 McIntyre
6,956,498 B1 10/2005 Gauthier et al.
6,962,235 B2 11/2005 Leon
6,973,740 B2 12/2005 Meyer
7,036,242 B2 5/2006 Komulainen et al.
7,036,575 B1 5/2006 Rodney et al.
7,039,301 B1 5/2006 Aisenberg et al.
7,040,021 B2 5/2006 Talavera
7,042,714 B2 * 5/2006 Hillman et al. ..... 361/679.21
7,055,262 B2 6/2006 Goldberg et al.
7,087,117 B2 8/2006 Katsuoka et al.
7,150,890 B2 12/2006 Rosales et al.
7,182,820 B2 * 2/2007 Campbell et al. ..... 134/19
7,284,391 B2 10/2007 Miller et al.
7,309,376 B2 12/2007 Barre et al.
7,316,080 B1 1/2008 Woolsey
7,380,348 B2 6/2008 Seebach
7,437,833 B2 10/2008 Sato et al.
7,442,257 B2 10/2008 Katsuoka et al.
7,506,458 B2 3/2009 Lee et al.
7,509,998 B1 3/2009 Rodney
7,526,833 B2 5/2009 Cochran et al.
7,555,209 B2 6/2009 Pradas Diez et al.
7,562,543 B2 7/2009 Kendall et al.
7,575,636 B2 8/2009 Katsuoka et al.
7,587,917 B2 9/2009 Gilboe et al.
7,596,883 B2 10/2009 Kameishi
7,597,122 B1 10/2009 Smith
7,614,160 B2 11/2009 Kameishi et al.
7,617,702 B2 11/2009 Sunshine et al.
7,624,600 B2 12/2009 Sunshine et al.
7,628,043 B2 12/2009 Sunshine et al.
7,640,678 B2 1/2010 Lee et al.
7,653,963 B2 2/2010 Cochran et al.
7,665,225 B2 2/2010 Goldberg et al.
7,802,340 B2 9/2010 Knopow et al.
7,832,697 B2 11/2010 West et al.
7,856,736 B2 * 12/2010 Churchill et al. ..... 34/90
7,946,055 B2 * 5/2011 Churchill et al. ..... 34/80
2001/0000576 A1 5/2001 Robinson
2001/0027795 A1 10/2001 Cain-Kozma et al.
2002/0004994 A1 1/2002 Rudd
2002/0046569 A1 4/2002 Faqih
2002/0078705 A1 6/2002 Schlosser et al.
2002/0092198 A1 7/2002 Bria et al.
2002/0132214 A1 9/2002 Mattson et al.
2002/0185987 A1 12/2002 Kushida et al.
2002/0198662 A1 12/2002 Chen
2003/0000036 A1 1/2003 Fan
2003/0066281 A1 4/2003 Mizumura et al.
2003/0071075 A1 4/2003 Frankenbach et al.
2003/0074718 A1 4/2003 English
2003/0159718 A1 8/2003 Kamikawa et al.
2003/0188448 A1 10/2003 Reed
2004/0031119 A1 2/2004 McKay
2004/0045168 A1 3/2004 Talavera
2004/0049940 A1 3/2004 Komulainen et al.
2004/0088817 A1 5/2004 Cochran et al.
2004/0090040 A1 5/2004 Pearson
2004/0108281 A1 6/2004 Gerteis et al.
2004/0111817 A1 * 6/2004 Chen et al. ..... 15/104.94
2004/0168342 A1 9/2004 Wakamatsu et al.
2004/0226312 A1 11/2004 Miller et al.
2004/0244090 A1 12/2004 Langer
2004/0255484 A1 12/2004 Storrer et al.
2005/0036283 A1 * 2/2005 Hillman et al. ..... 361/683
2005/0066538 A1 3/2005 Goldberg et al.
2005/0072358 A1 4/2005 Katsuoka et al.
2005/0076529 A1 4/2005 Holmes
2005/0076662 A1 * 4/2005 Roche et al. ..... 62/246
2005/0100436 A1 5/2005 Egusquiza
2005/0120508 A1 6/2005 Morgan et al.
2005/0153002 A1 7/2005 Socla Rosales et al.
2005/0211357 A1 9/2005 Ren
2005/0258114 A1 11/2005 Davis
2005/0262720 A1 12/2005 Rane et al.
2005/0273969 A1 12/2005 Watson et al.
2006/0000110 A1 1/2006 Aisenberg et al.
2006/0036198 A1 2/2006 Cafaro et al.
2006/0060082 A1 3/2006 Barre et al.
2006/0096118 A1 * 5/2006 Ward et al. ..... 34/487
2006/0171660 A1 8/2006 Hsu
2006/0179676 A1 8/2006 Goldberg et al.
2006/0180596 A1 8/2006 Young et al.
2006/0191901 A1 8/2006 Taylor et al.
2006/0201015 A1 9/2006 Russell
2006/0201018 A1 9/2006 McKay et al.
2006/0206233 A1 * 9/2006 Carpenter et al. ..... 700/159
2006/0230630 A1 10/2006 Lee et al.
2006/0236929 A1 10/2006 Katsuoka et al.
2006/0243204 A1 11/2006 Katsuoka et al.
2006/0243205 A1 11/2006 Katsuoka et al.
2006/0272120 A1 * 12/2006 Barrick et al. ..... 15/321
2006/0272170 A1 12/2006 Holmes
2006/0288508 A1 12/2006 Knopow et al.
2007/0033937 A1 2/2007 Baur et al.
2007/0079524 A1 4/2007 Sato et al.
2007/0094884 A1 * 5/2007 Micheludis ..... 34/107
2007/0113369 A1 5/2007 Cochran et al.
2007/0144034 A1 6/2007 Kameishi
2007/0160515 A1 7/2007 Mohrman
2007/0163141 A1 7/2007 Hsu
2007/0263994 A1 11/2007 Diez et al.
2007/0274822 A1 11/2007 Liu et al.
2007/0290110 A1 12/2007 West et al.
2008/0004963 A1 1/2008 Montalbano et al.
2008/0022551 A1 1/2008 Banta et al.
2008/0032066 A1 * 2/2008 Stiblert et al. ..... 427/595
2008/0052952 A1 3/2008 Nelson
2008/0127830 A1 6/2008 Le et al.
2008/0209760 A1 * 9/2008 French et al. ..... 34/585
2008/0216342 A1 9/2008 Kameishi et al.
2008/0216343 A1 * 9/2008 Churchill et al. ..... 34/202
2008/0216344 A1 * 9/2008 Churchill et al. ..... 34/202
2008/0222910 A1 * 9/2008 Churchill et al. ..... 34/202
2008/0253754 A1 10/2008 Rubin
2008/0256825 A1 10/2008 Hsu
2008/0259566 A1 10/2008 Fried
2008/0263889 A1 10/2008 Fukaya et al.
2008/0272734 A1 11/2008 Ren
2008/0301970 A1 * 12/2008 Hackwell et al. ..... 34/202
2008/0313918 A1 * 12/2008 Dyson et al. ..... 34/202
2008/0313919 A1 * 12/2008 Churchill et al. ..... 34/202
2008/0317448 A1 12/2008 Brown et al.
2009/0000142 A1 * 1/2009 Churchill et al. ..... 34/95
2009/0004962 A1 1/2009 Collins
2009/0034946 A1 * 2/2009 Caine et al. ..... 392/380
2009/0044420 A1 2/2009 Hsu

| | | | | |
|---|---|---|---|---|
| 2009/0071030 | A1 | 3/2009 | Myung et al. | |
| 2009/0077736 | A1 | 3/2009 | Loberger et al. | |
| 2009/0113746 | A1* | 5/2009 | Churchill et al. | 34/202 |
| 2009/0113748 | A1* | 5/2009 | Dyson et al. | 34/232 |
| 2009/0119942 | A1 | 5/2009 | Aisenberg et al. | |
| 2009/0130745 | A1* | 5/2009 | Williams et al. | 435/287.2 |
| 2009/0195877 | A1 | 8/2009 | Nakai | |
| 2009/0221059 | A1* | 9/2009 | Williams et al. | 435/287.2 |
| 2009/0236629 | A1 | 9/2009 | Nishikawa et al. | |
| 2009/0255142 | A1 | 10/2009 | Brown | |
| 2009/0293304 | A1 | 12/2009 | Yang | |
| 2009/0320316 | A1 | 12/2009 | Zakai | |
| 2010/0005614 | A1 | 1/2010 | Cochran et al. | |
| 2010/0024244 | A1 | 2/2010 | Potter | |
| 2010/0052408 | A1 | 3/2010 | Ren | |
| 2010/0119755 | A1 | 5/2010 | Chung et al. | |
| 2010/0130686 | A1 | 5/2010 | Oshima | |
| 2010/0154239 | A1* | 6/2010 | Hutchinson | 34/82 |
| 2010/0154863 | A1* | 6/2010 | Bennett et al. | 136/246 |
| 2010/0192399 | A1 | 8/2010 | Sawabe et al. | |
| 2010/0209080 | A1 | 8/2010 | Rubin et al. | |
| 2010/0210745 | A1 | 8/2010 | Mcdaniel et al. | |
| 2010/0212177 | A1* | 8/2010 | Chen | 34/97 |
| 2010/0227963 | A1 | 9/2010 | Hironaka et al. | |
| 2011/0082021 | A1 | 4/2011 | Burns | |
| 2011/0099834 | A1 | 5/2011 | Brown | |
| 2011/0131829 | A1 | 6/2011 | Zagar et al. | |

FOREIGN PATENT DOCUMENTS

| | | | |
|---|---|---|---|
| CH | 645 277 | | 9/1984 |
| CH | 669 116 | | 2/1989 |
| DE | 548 998 | | 4/1932 |
| DE | 26 57 164 | | 6/1978 |
| DE | 31 16 285 | | 2/1983 |
| DE | 32 04 258 | | 8/1983 |
| DE | 32 18 578 | | 11/1983 |
| DE | 34 40 412 | | 3/1986 |
| DE | 35 30 888 | | 3/1986 |
| DE | 34 43 438 | | 5/1986 |
| DE | 34 43 439 | | 5/1986 |
| DE | 35 13 159 | | 10/1986 |
| DE | 35 27 835 | | 2/1987 |
| DE | 35 29 410 | | 2/1987 |
| DE | 37 35 197 | | 5/1989 |
| DE | 38 14 489 | | 11/1989 |
| DE | 40 22 003 | | 1/1992 |
| DE | 41 07 439 | | 9/1992 |
| DE | 41 07 489 | | 9/1992 |
| DE | 42 18 658 | | 12/1992 |
| DE | 42 08 680 | | 9/1993 |
| DE | 44 28 978 | | 3/1995 |
| DE | 196 12 923 | | 10/1997 |
| DE | 196 54 756 | | 7/1998 |
| DE | 101 09 237 | | 9/2002 |
| DE | 101 14 473 | | 10/2002 |
| DE | 101 47 778 | | 4/2003 |
| DE | 101 57 975 | | 6/2003 |
| EP | 0 059 888 | | 9/1982 |
| EP | 0 068 491 | | 1/1983 |
| EP | 0 251 898 | | 1/1988 |
| EP | 0 329 171 | | 8/1989 |
| EP | 0 357 305 | | 3/1990 |
| EP | 0 382 521 | | 8/1990 |
| EP | 0 393 254 | | 10/1990 |
| EP | 0 567 678 | | 11/1993 |
| EP | 0 574 160 | | 12/1993 |
| EP | 0 589 568 | | 3/1994 |
| EP | 0 644 334 | | 3/1995 |
| EP | 0 679 358 | | 11/1995 |
| EP | 0 832 697 | | 4/1998 |
| EP | 0 855 736 | | 7/1998 |
| EP | 0 976 356 | | 2/2000 |
| EP | 1 166 704 | | 1/2002 |
| EP | 1 250 878 | | 10/2002 |
| EP | 1 250 879 | | 10/2002 |
| FR | 2 537 425 | | 6/1984 |
| FR | 2 543 592 | | 10/1984 |
| FR | 2 569 029 | | 2/1986 |
| FR | 2 577 109 | | 8/1986 |
| FR | 2 582 196 | | 11/1986 |
| FR | 2 588 741 | | 4/1987 |
| FR | 2 595 455 | | 9/1987 |
| FR | 2595455 | A1 * | 9/1987 |
| FR | 2 597 717 | | 10/1987 |
| FR | 2 790 979 | | 9/2000 |
| GB | 680148 | | 10/1952 |
| GB | 2 012 362 | | 7/1979 |
| GB | 2 050 609 | | 1/1981 |
| GB | 2 054 151 | | 2/1981 |
| GB | 2 057 528 | | 4/1981 |
| GB | 2 085 725 | | 5/1982 |
| GB | 2 112 639 | | 7/1983 |
| GB | 2 116 034 | | 9/1983 |
| GB | 2 136 291 | | 9/1984 |
| GB | 2 137 878 | | 10/1984 |
| GB | 2 142 128 | | 1/1985 |
| GB | 2 144 325 | | 3/1985 |
| GB | 2 147 804 | | 5/1985 |
| GB | 2 179 856 | | 3/1987 |
| GB | 2 189 382 | | 10/1987 |
| GB | 2 196 843 | | 5/1988 |
| GB | 2 198 229 | | 6/1988 |
| GB | 2 236 248 | | 4/1991 |
| GB | 2 249 026 | | 4/1992 |
| GB | 2 253 035 | | 8/1992 |
| GB | 2434094 | A * | 7/2007 |
| JP | 61-21393 | | 2/1986 |
| JP | 63-154138 | | 6/1988 |
| JP | 63-279033 | | 11/1988 |
| JP | 2-52973 | | 2/1990 |
| JP | 3-82419 | | 4/1991 |
| JP | 3-82420 | | 4/1991 |
| JP | 4-73026 | | 3/1992 |
| JP | 06-062979 | A | 3/1994 |
| JP | 06-209879 | A | 8/1994 |
| JP | 7-79880 | | 3/1995 |
| JP | 7-116076 | | 5/1995 |
| JP | 7-308266 | | 11/1995 |
| JP | 8-187209 | | 7/1996 |
| JP | 9-66003 | | 3/1997 |
| JP | 9-135789 | | 5/1997 |
| JP | 10-113304 | | 5/1998 |
| JP | 10-248748 | | 9/1998 |
| JP | 11-70058 | | 3/1999 |
| JP | 11056673 | A * | 3/1999 |
| JP | 11-244191 | | 9/1999 |
| JP | 2000000178 | A * | 1/2000 |
| JP | 2000-245653 | | 9/2000 |
| JP | 2000300465 | A * | 10/2000 |
| JP | 2000-316747 | A | 11/2000 |
| JP | 2001-157647 | | 6/2001 |
| JP | 2001-275898 | | 10/2001 |
| JP | 2001-346715 | | 12/2001 |
| JP | 2002-034835 | | 2/2002 |
| JP | 2002-34845 | | 2/2002 |
| JP | 2002-34852 | | 2/2002 |
| JP | 2002-136448 | | 5/2002 |
| JP | 2002-306370 | | 10/2002 |
| JP | 2003-180554 | | 7/2003 |
| JP | 2004-105511 | | 4/2004 |
| JP | 2004-113615 | | 4/2004 |
| JP | 2004-113712 | | 4/2004 |
| JP | 2004-231935 | | 8/2004 |
| JP | 2004-305287 | | 11/2004 |
| JP | 2004-357820 | | 12/2004 |
| JP | 2005-168799 | | 6/2005 |
| JP | 2005-291274 | | 10/2005 |
| JP | 2006-187397 | | 7/2006 |
| WO | WO 85/03462 | | 8/1985 |
| WO | WO 85/04184 | | 9/1985 |
| WO | WO 86/06693 | | 11/1986 |
| WO | WO-87/07040 | | 11/1987 |
| WO | WO 97/34708 | | 9/1997 |
| WO | WO 98/26703 | | 6/1998 |
| WO | WO 98/53752 | | 12/1998 |
| WO | WO 99/53250 | | 10/1999 |
| WO | WO-01/25705 | A | 4/2001 |
| WO | WO 03/024291 | | 3/2003 |

| | | | | |
|---|---|---|---|---|
| WO | WO 2004/100743 | | | 11/2004 |
| WO | WO 2005/029687 | | | 3/2005 |
| WO | WO-2005/074776 | | | 8/2005 |
| WO | WO 2007015039 | A1 | * | 2/2007 |
| WO | WO 2007015040 | A1 | * | 2/2007 |
| WO | WO 2007015042 | A1 | * | 2/2007 |
| WO | WO 2007015044 | A1 | * | 2/2007 |
| WO | WO 2007015045 | A1 | * | 2/2007 |

OTHER PUBLICATIONS

GB Search Report dated Oct. 27, 2005, directed to GB application No. GB0515749.0 (1 pages).

GB Search Report dated Aug. 24, 2006, directed to GB application No. GB0600879.1 (1 pages).

Churchill et al., U.S. Office Action mailed Apr. 1, 2010, directed to U.S. Appl. No. 11/997,301; 10 pages.

Churchill et al., U.S. Office Action mailed Oct. 22, 2010, directed to U.S. Appl. No. 11/997,301; 15 pages.

French et al., U.S. Office Action mailed Aug. 11, 2011, directed to U.S. Appl. No. 11/997,309; 9 pages.

Churchill et al., U.S. Office Action mailed Apr. 1, 2010, directed to U.S. Appl. No. 11/997,303; 9 pages.

Churchill et al., U.S. Office Action mailed Aug. 17, 2010, directed to U.S. Appl. No. 11/997,303; 7 pages.

Dyson et al., U.S. Office Action mailed Jul. 22, 2011, directed to U.S. Appl. No. 11/997,302; 14 pages.

Caine et al., U.S. Office Action mailed Jul. 8, 2011, directed to U.S. Appl. No. 12/159,559; 6 pages.

Hutchinson, U.S. Office Action mailed Jun. 24, 2010, directed to U.S. Appl. No. 12/160,961; 8 pages.

Hutchinson, U.S. Office Action mailed Dec. 9, 2010, directed to U.S. Appl. No. 12/160,961; 10 pages.

* cited by examiner

DRYING APPARATUS

REFERENCE TO RELATED APPLICATIONS

This application is a national stage application under 35 USC 371 of International Application No. PCT/GB2006/002347, filed Jun. 26, 2006, which claims the priority of United Kingdom Application Nos. 0515749.0, filed Jul. 30, 2005, and 0600879.1, filed Jan. 17, 2006, the contents of which prior applications are incorporated herein by reference.

FIELD OF THE INVENTION

The invention relates to drying apparatus which makes use of a narrow jet of high velocity, high pressure air to dry an object, including part of the human body. Particularly, but not exclusively, the invention relates to a hand dryer in which the air jet is emitted through a slot-like opening in the casing of the hand dryer.

BACKGROUND OF THE INVENTION

The use of air jets to dry hands is well known. Examples of hand dryers which emit at least one air jet through a slot-like opening are shown in GB 2249026A, JP 2002-034835A and JP 2002306370A. However, in practice it is very difficult to achieve an airflow of sufficiently high momentum to dry the user's hands efficiently in an acceptably short length of time. The prior art does not achieve this.

SUMMARY OF THE INVENTION

It is an object of the invention to provide drying apparatus which, in use, emits an air jet through an opening which is capable of drying an object in a short time as compared to the prior art. It is another object to provide a hand dryer which is capable of drying the user's hands in a short time in comparison to the prior art. It is a further object of the invention to provide an improved hand dryer in which the drying efficiency is improved in comparison to the prior art.

The invention provides drying apparatus having a casing, a cavity formed in the casing for receiving an object, a fan located in the casing and capable of creating an airflow, a motor arranged to drive the fan, and at least one opening communicating with the fan and arranged in the casing so as to direct an airflow transversely across the cavity, wherein, in use, the pressure of the airflow emitted through the opening is at least 8 kPa.

By providing a fan or fan apparatus capable of generating a high pressure airflow, the momentum of the airflow emitted through the opening is greatly increased in comparison to that of the prior art devices. This increases the efficiency of the dryer by virtue of the fact that more water is blown from the object during each pass thereof through the airflow exiting the slot-like openings.

Preferably, the high pressure airflow is generated by providing a high speed motor to drive a fan, more preferably the rotor is capable of rotating at a speed of at least 80,000 rpm and preferably at a speed of at least 100,000 rpm. More preferably, the motor is a switched-reluctance motor. This preferred arrangement provides the airflow with a particularly effective level of momentum.

Alternatively, the motor includes a first and a second motor, the first motor being arranged to drive a first fan and the second motor being arranged to drive a second fan. The first and second motors are arranged to drive the first and second fan in series. In a further alternative arrangement the fan is a two stage fan, and the motor is arranged to drive the first and second stages of the fan in parallel.

In a preferred embodiment, a hand dryer has a pair of opposed slot-like openings arranged to direct an airflow across the cavity. The preferred width of the slot-like openings is no more than 0.5 mm. Such an arrangement has been found to be highly effective in producing a hand dryer which is capable of drying a user's hands effectively and quickly.

BRIEF DESCRIPTION OF THE DRAWINGS

An embodiment of the invention in the form of a hand dryer will now be described with reference to the accompanying drawings, in which.

DETAILED DESCRIPTION OF THE INVENTION

Figure 2:
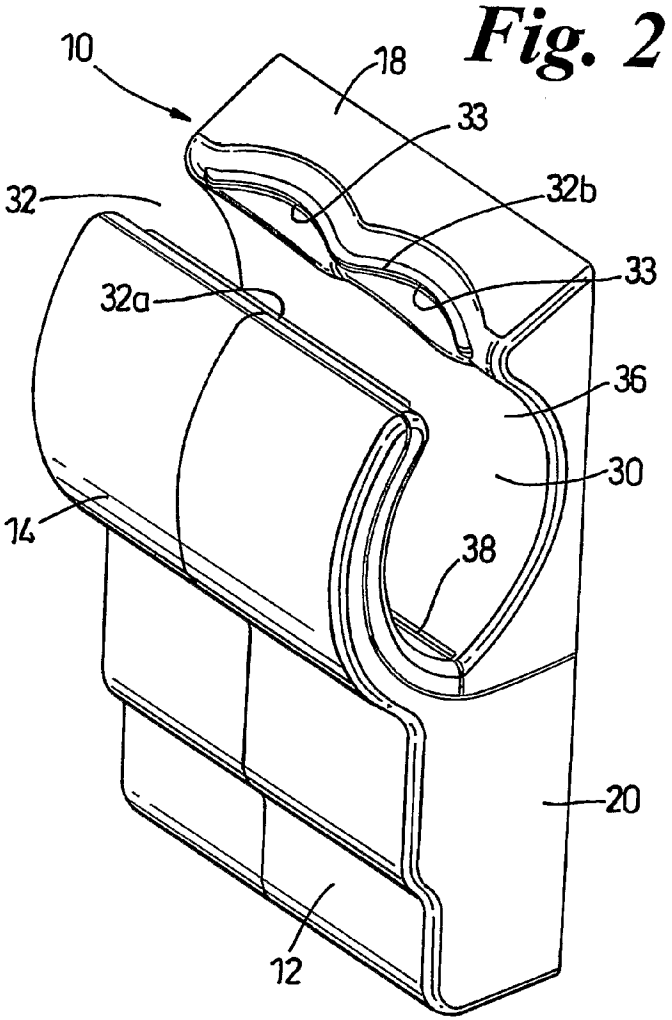
FIG. 2 is a perspective view of the hand dryer of FIG. 1.
Figure 1:
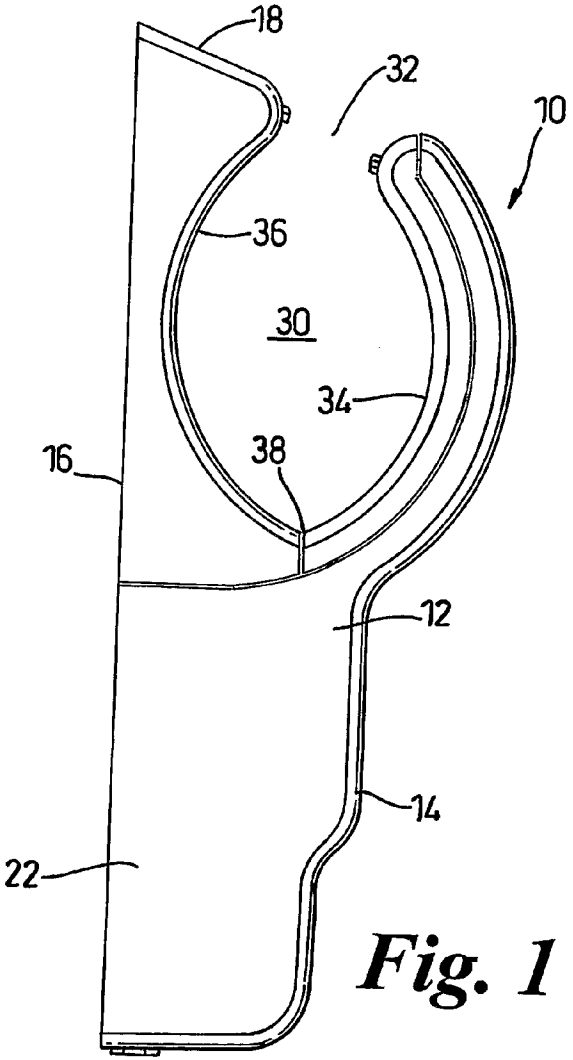
FIG. 1 is a side view of a hand dryer according to the invention.

Referring firstly to FIGS. 1 and 2, the hand dryer 10 shown in the drawings comprises an outer casing 12 having a front wall 14, a rear wall 16, an upper face 18 and side walls 20, 22. The rear wall 16 can incorporate fixing devices (not shown) for securing the hand dryer 10 to a wall or other structure prior to use. An electrical connection (not shown) is also provided on the rear wall or elsewhere on the casing 12. A cavity 30 is formed in the upper part of the casing 12 as can be seen from FIGS. 1 and 2. The cavity 30 is open at its upper end and delimited thereat by the top of the front wall 14 and the front of the upper face 18. The space between the top of the front wall 14 and the front of the upper face 18 forms a cavity entrance 32 which is sufficiently wide to allow a user's hands to be introduced to the cavity 30 through the cavity entrance 32. The cavity 30 is also open to the sides of the hand dryer 10 by appropriate shaping of the side walls 20, 22.

The cavity 30 has a front wall 34 and a rear wall 36 which delimit the cavity 30 to the front and rear respectively. Located in the lowermost end of the cavity 30 is a drain 38 which communicates with a reservoir (not shown) located in the lower part of the casing 12. The purpose of the drain and reservoir will be described below.

Figure 3:
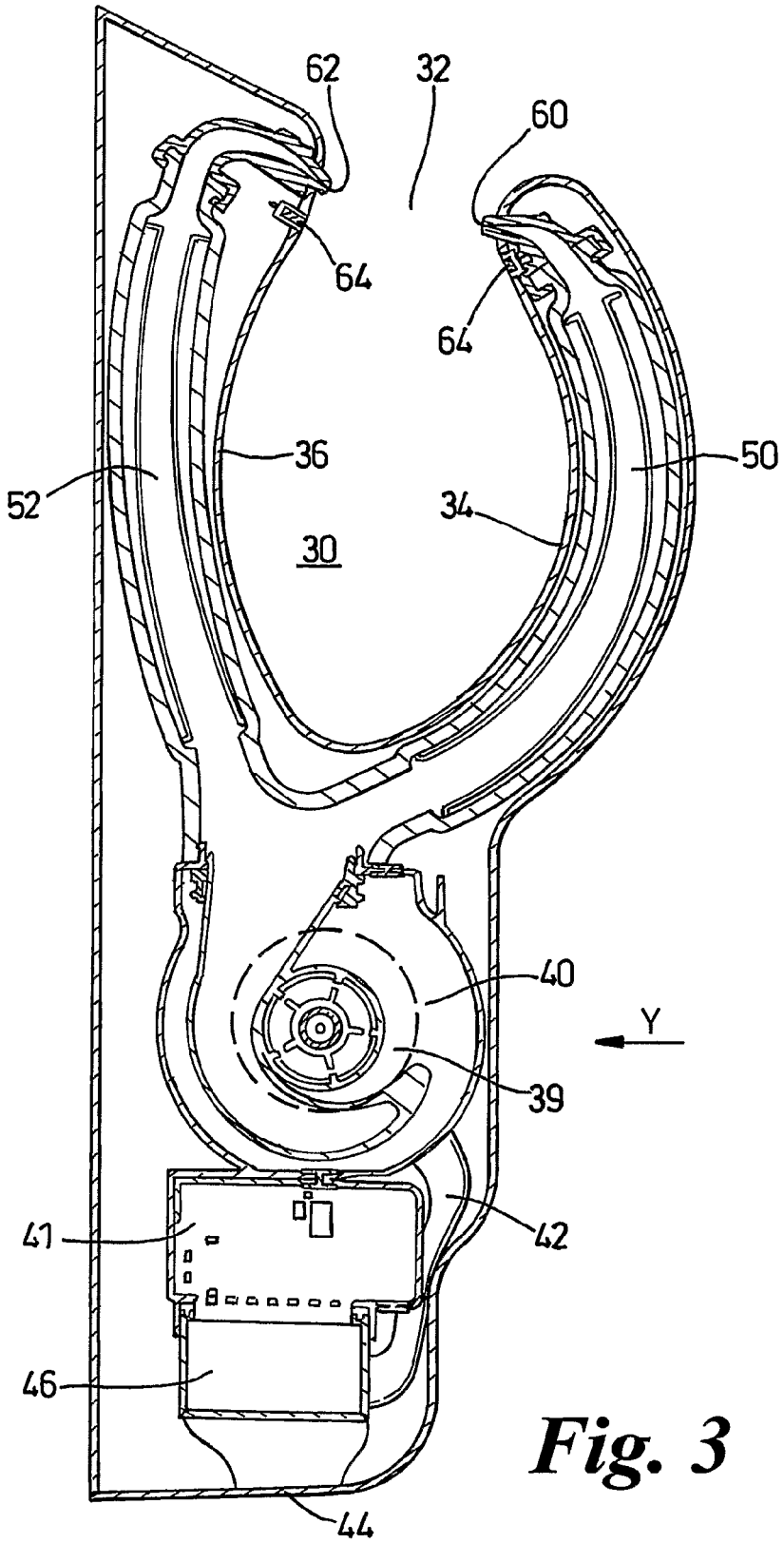
FIG. 3 is a side sectional view of the hand dryer of FIG. 1.

As shown in FIG. 3, a motor 39 is located inside the casing 12 and a fan 40, which is driven by the motor 39, is also located inside the casing 12. The motor 39 is a brushless switched-reluctance motor and is connected to the electrical connection and is controlled by a controller 41. The inlet 42 of the fan 40 communicates with an air inlet 44 formed in the casing 12. A filter 46 is located in the air passageway connecting the air inlet 44 to the fan inlet 42 so as to prevent the ingress of any debris which might cause damage to the motor or the fan 40. The outlet of the fan 40 communicates with a pair of air ducts 50, 52 which are located inside the casing 12. The front air duct 50 is located primarily between the front wall 14 of the casing 12 and the front wall 34 of the cavity 30, and the rear air duct 52 is located primarily between the rear wall 16 of the casing 12 and the rear wall 36 of the cavity 30.

The air ducts 50, 52 are arranged to conduct air from the fan 40 to a pair of opposed slot-like openings 60, 62 which are located in the front and rear walls 34, 36 respectively of the cavity 30. The slot-like openings 60, 62 are arranged at the upper end of the cavity 30 in the vicinity of the cavity entrance 32. The slot-like openings 60, 62 are each configured so as to direct an airflow generally across the cavity entrance 32 towards the opposite wall of the cavity 30. The slot-like openings 60, 62 are offset in the vertical direction and angled towards the lowermost end of the cavity 30.

Figure 4:
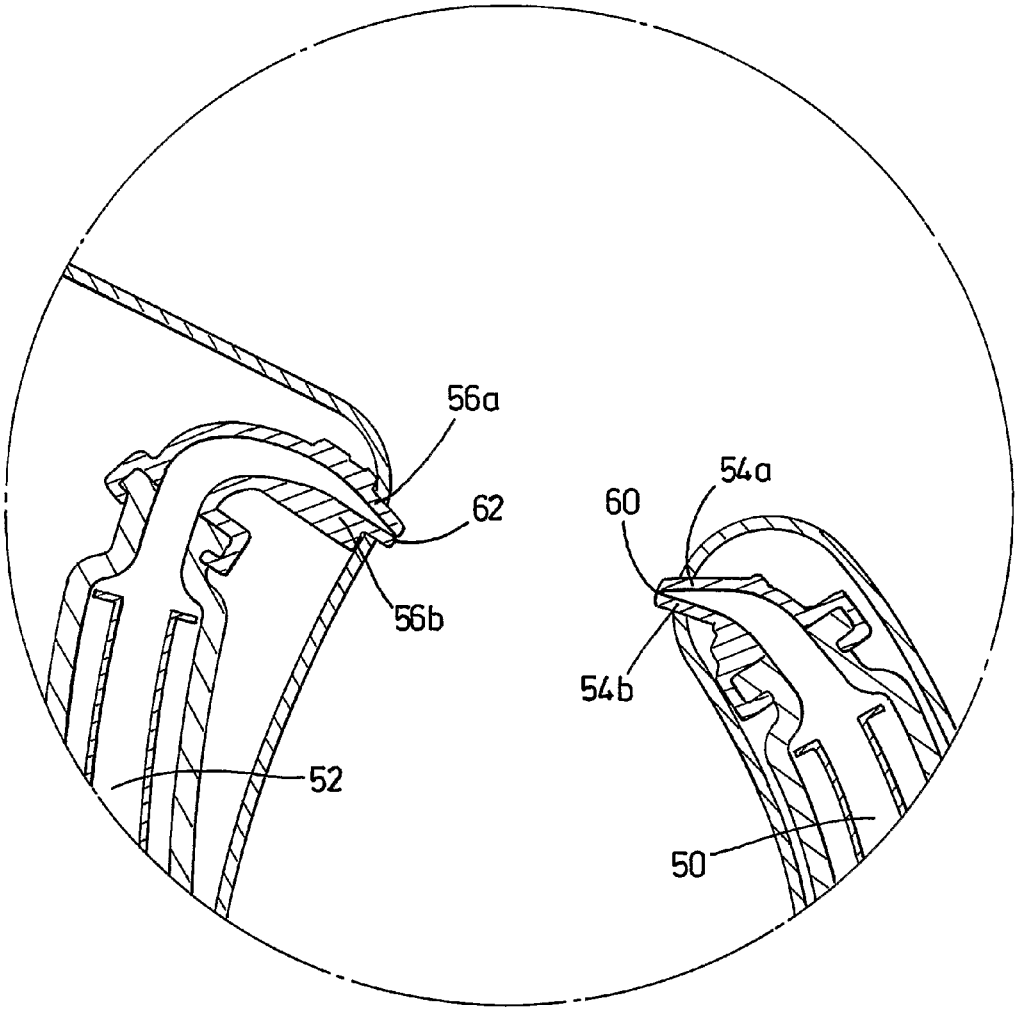
FIG. 4 is a side sectional view, shown on an enlarged scale, of the upper ends of the air ducts forming part of the hand dryer of FIG. 1.
Figure 5:
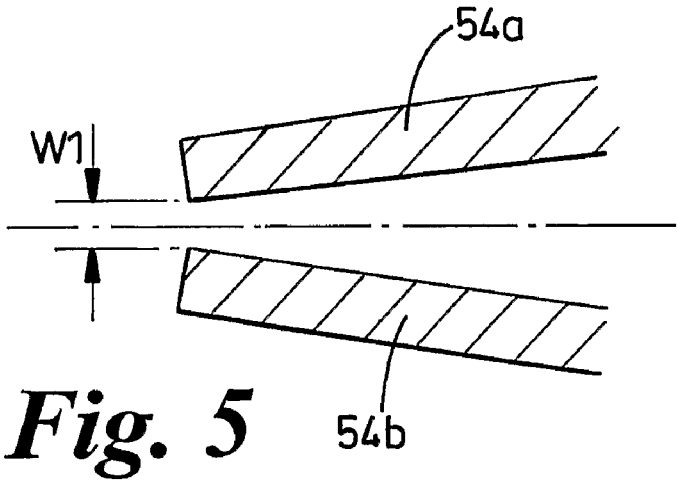
FIG. 5 is a schematic sectional side view, shown on a further enlarged scale, of the slot-like opening located in the front wall of the cavity of the hand dryer of FIG. 1.
Figure 6:
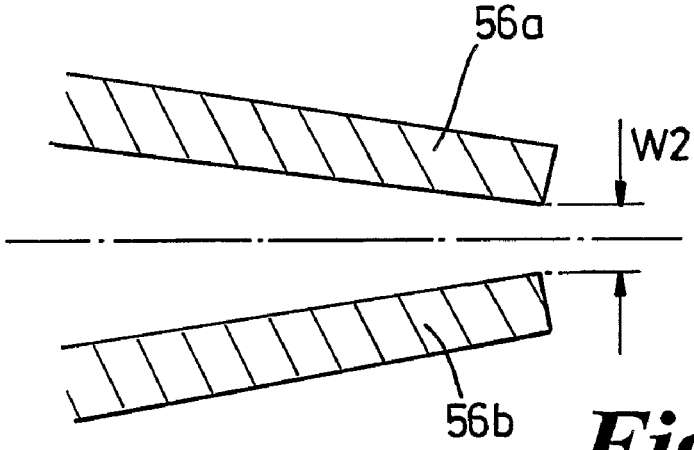
FIG. 6 is a schematic sectional side view, shown on the same further enlarged scale, of the slot-like opening located in the rear wall of the cavity of the hand dryer of FIG. 1.

FIG. 4 shows the upper ends of the air ducts 50, 52 and the slot-like openings 60, 62 in greater detail. As can be seen, the walls 54*a*, 54*b* of the air duct 50 converge to form the slot-like opening 60 and the walls 56*a*, 56*b* of the air duct 52 converge to form the slot-like opening 62. Even greater detail can be seen in FIGS. 5 and 6. FIG. 5 shows that the slot-like opening 60 has a width of W1 and FIG. 6 shows that the slot-like opening 62 has a width of W2. The width W1 of the slot-like opening 60 is smaller than the width W2 of the slot-like opening 62. The width W1 is 0.3 mm and the width W2 is 0.4 mm.

Sensors 64 are positioned in the front and rear walls 34, 36 of the cavity 30 immediately below the slot-like openings 60, 62. These sensors 64 detect the presence of a user's hands which are inserted into the cavity 30 via the cavity entrance 32 and are arranged to send a signal to the motor when a user's hands are introduced to the cavity 30. As can be seen from FIGS. 1 and 3, the walls 54*a*, 54*b*, 56*a*, 56*b* of the ducts 50, 52 project slightly beyond the surface of the front and rear walls 34, 36 of the cavity 30. The inward projection of the walls 54*a*, 54*b*, 56*a*, 56*b* of the ducts 50, 52 reduces the tendency of the user's hands to be sucked towards one or other of the walls 34, 36 of the cavity, which enhances the ease with which the hand dryer 10 can be used. The positioning of the sensors 64 immediately below the inwardly projecting walls 54*a*, 54*b*, 56*a*, 56*b* of the ducts 50, 52 also reduces the risk of the sensors 64 becoming dirty and inoperative.

As can be seen from FIG. 2, the shape of the cavity entrance 32 is such that the front edge 32*a* is generally straight and extends laterally across the width of the hand dryer 10. However, the rear edge 32*b* has a shape which consists of two curved portions 33 which generally follow the shape of the backs of a pair of human hands as they are inserted downwardly into the cavity 30 through the cavity entrance 32. The rear edge 32*b* of the cavity entrance 32 is substantially symmetrical about the centre line of the hand dryer 10. The intention of the shaping and dimensioning of the front and rear edges 32*a*, 32*b* of the cavity entrance 32 is that, when a user's hands are inserted into the cavity 30 through the cavity entrance 32, the distance from any point on the user's hands to the nearest slot-like opening is substantially uniform.

The hand dryer 10 described above operates in the following manner. When a user's hands are first inserted into the cavity 30 through the cavity entrance 32, the sensors 64 detect the presence of the user's hands and send a signal to the motor 39 to drive the fan 40. The motor 39 has a rotor which is then driven at a very high speed, namely at a speed of at least 80,000 rpm and preferably at a speed of at least 100,000 rpm. The fan 40 is thus rotated at a similarly very high speed and air is drawn into the hand dryer 10 via the air inlet 44 at a rate of approximately 20 to 40 litres per second and preferably at a rate of least 25 to 27 litres per second, more preferably air is drawn into the hand dryer 10 at a rate of 31 to 35 litres per second. The air passes through the filter 46 and along the fan inlet 42 to the fan 40. The airflow leaving the fan 40 is divided into two separate airflows; one passing along the front air duct 50 to the slot-like opening 60 and the other passing along the rear air duct 52 to the slot-like opening 62.

The airflow ejected from the slot-like openings 60, 62 in the form of very thin, stratified sheets of high velocity air. The airflow approaching the slot-like openings is in the form of sheets of high velocity, high pressure air. As the airflows approach and leave the slot-like openings 60, 62, the air pressure is at least 15 kPa and preferably approximately 20 to 23 kPa, or preferably at least 23 kPa and more preferably 25 to 30 kPa. Furthermore, the speed of the airflow leaving the slot-like openings 60, 62 is at least 80 m/s and preferably at least 100 or 150 m/s, more preferably approximately 180 m/s. Because the size of the slot-like opening 62 located at the end of the rear duct 52 is greater than the size of the slot-like opening 60 located at the end of the front duct 50, a larger volume of air is emitted from the duct 52 than from the duct 50. This provides a greater mass of air for drying the backs of the user's hands which is advantageous.

The two thin sheets of stratified, high velocity, high pressure air are directed towards the surfaces of the user's hands which, during use, are inserted fully into the cavity 30 and are subsequently withdrawn from the cavity 30 via the cavity entrance 32. As the user's hands pass into and out of the cavity 30, the sheets of air blow any existing water off the user's hands. This is achieved reliably and effectively because of the high pressure of the air moving towards the slot-like openings 60, and 62 and due to the momentum of the air leaving the slot-like openings 60, 62 and also because the airflow is evenly distributed along the length of each slot-like opening 60, 62.

Each stratified sheet of air is directed towards the wall of the cavity 30 which is remote from the slot-like opening through which the respective sheet of air is emitted. Because the slot-like openings 60, 62 are also inclined towards the lowermost end of the cavity 30, the emitted airflows are directed into the cavity 30. This reduces the risk of turbulent air movement being felt by the user outside the casing, eg in the user's face.

It is envisaged that it will take only a small number of "passes" of the hand dryer described above to dry a user's hands to a satisfactory degree. (By "pass", we mean a single insertion of the hands into the cavity and subsequent removal therefrom at a speed which is not unacceptable to an average user. We envisage that a single pass will have a duration of no more than 3 seconds.) The momentum achieved by the airflows is sufficient to remove the majority of water found on the surface of the user's hands after washing during a single pass.

The water removed by the airflows is collected inside the cavity 30. Each airflow will rapidly lose its momentum once it has passed the user's hands and the water droplets will fall to the lower end of the cavity 30 under the forces of gravity whilst the air exits the cavity 30 either through the cavity entrance 32 or via the open sides of the cavity 30. The water, however, is collected by the drain 38 and passed to a reservoir (not shown) where it is collected for disposal. The reservoir can be emptied manually if desired. Alternatively, the hand dryer 10 can incorporate some form of water dispersal system including, for example, a heater for evaporating the collected water into the atmosphere. The means by which the collected water is dispersed does not form part of the present invention.

Figures 7A, 7B:
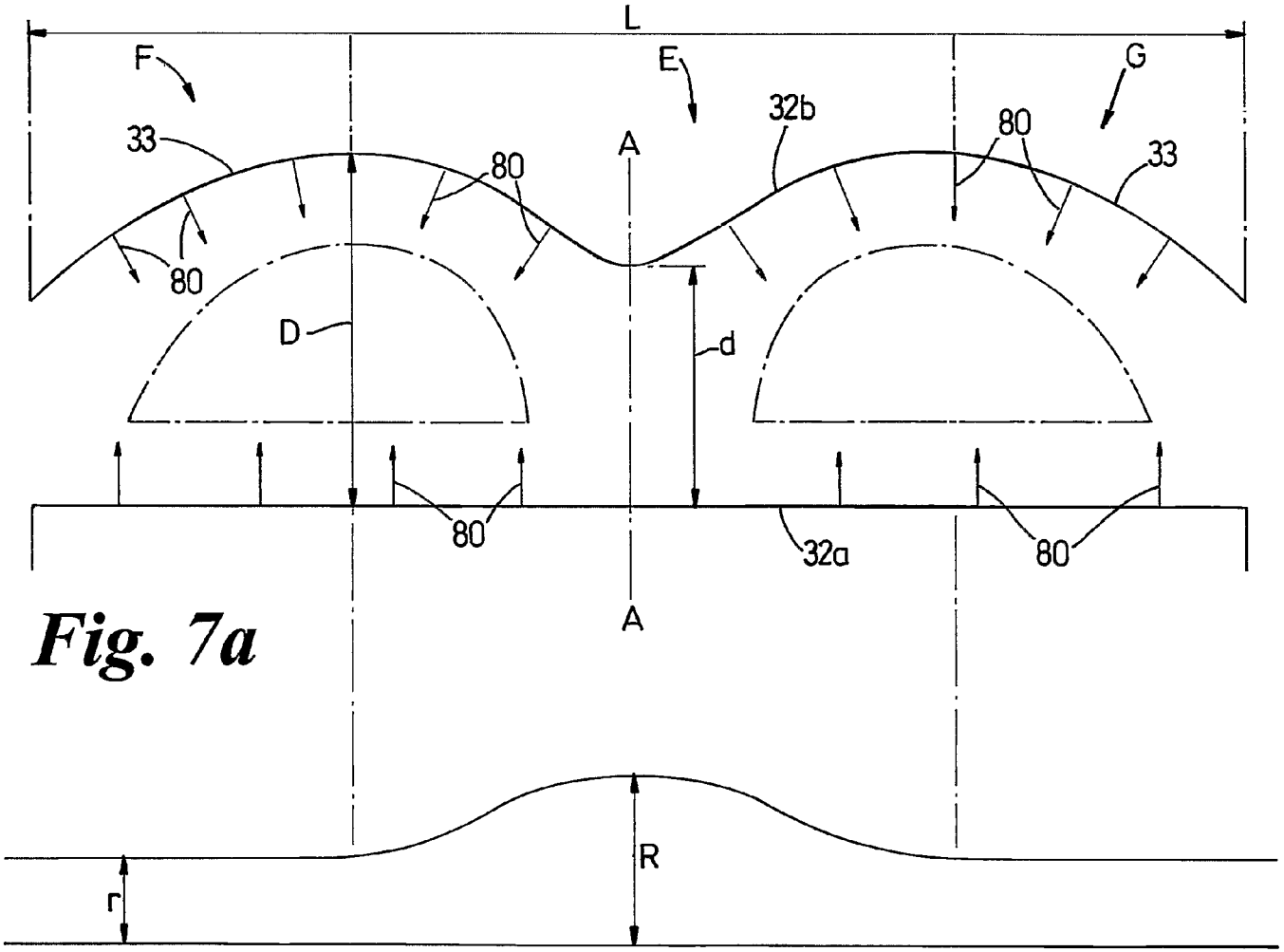
FIG. 7*a* is a plan view of the cavity entrance of a hand dryer according to a second embodiment of the invention.
FIG. 7*b* is a front view of the slot-like opening located in the rear wall of the cavity of the hand dryer of FIG. 7*a;*

In an alternative embodiment shown in FIGS. 7*a* and 7*b* the slot-like openings are not of constant width across the length L of the cavity of the hand dryer. FIG. 7*a* shows a plan view of the cavity entrance of length L. The dotted lines indicate the position and shape of the user's hands as they are normally inserted into the cavity 30 between the front and rear edges 32*a*, 32*b*. The arrows 80 shown in FIG. 7*a* indicate the direction of the airflow emitted from the slot-like openings 60, 62 located in the edges 32*a*, 32*b* of the cavity entrance 32. In this embodiment the curved portions 33 of the rear edge 32*b* are symmetrical about the centre line A-A of the cavity entrance 32 with the centre portion of the rear edge 32*b* being closer to the front edge 32*a* at the centre line than at a position spaced from the centre line. The minimum distance d between the front and rear edges 32*a*, 32*b* is at the centre line. The distance between the front edge 32*a* and the rear edge 32*b* is at a maximum, D, at the mid point of each curved portion. FIG. 7*b* shows the shape of the slot-like opening located in the rear wall of the cavity.

Preferably, the width of the slot-like opening in the rear wall varies gradually, increasing towards the mid point of the opening, at centre line A-A of cavity entrance 32.

In this alternative embodiment it is preferred that the variation in width of the opening is achieved by varying the distance of the upper wall of the slot-like opening away from the lower wall, in the shape of a curve, preferably in a smoothly curving shape. More preferably the curve is symmetrical about centre line A-A of the cavity entrance 32. Preferably the maximum width R of the opening is at centre line A-A and is 0.7 mm.

Preferably, the width r is substantially constant in regions F and G with the varying width region (region E in FIGS. 7*a* and 7*b*) comprising at least half the total length L of the cavity entrance, most preferably the central half. Preferably r is 0.4 mm.

In region E of the hand dryer the width of the slot-like opening 62 is greater than the width of the slot-like opening 62 in regions F and G. The increase in size of the slot-like opening 62 provides a greater mass of air 80 from rear duct 52 for drying the backs of the user's hands in the thumb and forefinger area which is advantageous. The greater mass of air in region E and the momentum achieved by the airflow is sufficient to remove the majority of water found on the backs of the user's hands after washing during a single pass.

Figure 8B:
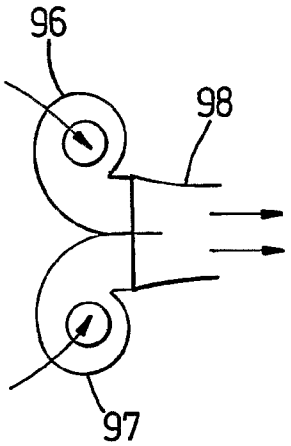
FIG. 8*b* is a schematic sectional side view of the motor arrangement of FIG. 8*a;*
Figure 8A:
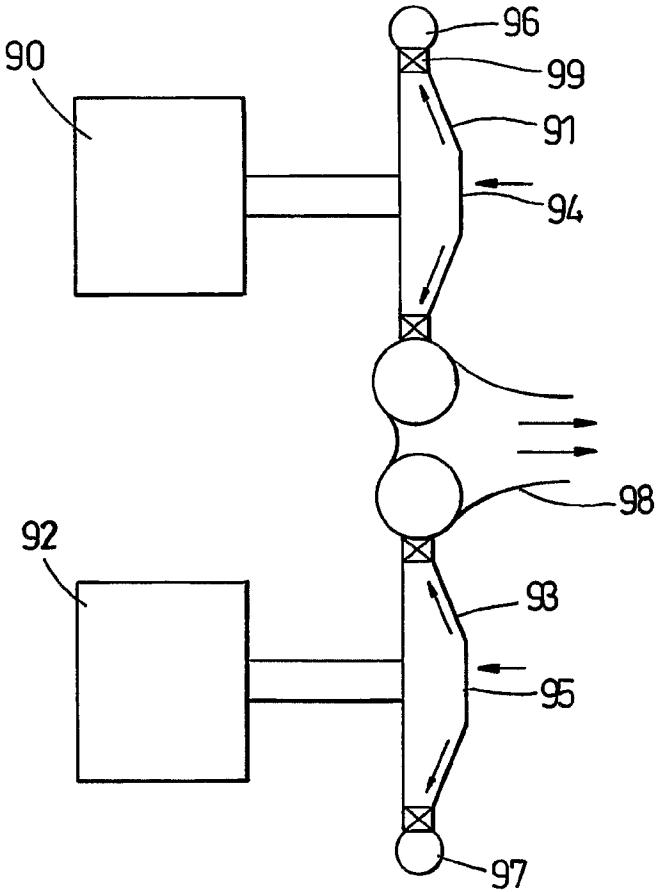
FIG. 8*a* is a schematic sectional front view, viewed from direction Y of FIG. 2, of a motor arrangement for a hand dryer according to a third embodiment of the invention.

In a further alternative embodiment shown in FIGS. 8*a* and 8*b* the high pressure airflows are generated with an alternative motor and fan arrangement. The arrows shown in FIGS. 8*a* and 8*b* represent the airflows through the motor arrangement. Motors 90 and 92, and fans 91 and 93, which are driven by motors 90 and 92, are located inside the casing 12. As shown in FIG. 8*a* fan 91 is driven by motor 90 and fan 93 is driven by motor 92. The motors are AC motors and each is connected to the electrical connection and is controlled by a controller. The inlet 94, 95 of each fan 91, 93 communicates with an air inlet 44 (not shown) formed in the casing 12. The outlet 96, 97 of each fan 91, 93 is in the form of a scroll or collector and communicates with a common collector 98. A diffuser element 99 is provided in outlet scrolls 96, 97 to increase the airflow pressure. The common collector 98 communicates with a pair of air ducts 50, 52 which are located inside the casing 12.

The motor 90, 92 and fan 91, 93 arrangement described above operates in the following manner. As in the first embodiment described above, when a user's hands are first inserted into the cavity 30 through the cavity entrance 32, the sensors 64 detect the presence of the user's hands and send a signal to motors 90, 92 to drive the fans 91, 93. Each motor 90, 92 has a rotor which is then driven at a speed, of approximately 30,000 to 40,000 rpm. Each fan 91, 93 is thus rotated at a similar speed and air is drawn into the hand dryer 10 via the air inlet 44 at a rate of approximately 20 to 40 litres per second. The arrangement of the fans in parallel creates a high volume airflow. The air passes along fan inlet 94 to the fan 91 and air passes along fan inlet 95 to the fan 93. The airflow leaving fan 91 is collected in scroll 96 and the airflow leaving fan 93 is collected in scroll 97. The airflows are collected in a common collector 98. The airflow leaving the common collector 98 is divided into two separate airflows; one passing along front air duct 50 to the slot-like opening 60 and the other passing along the rear air duct 52 to the slot-like opening 62.

Figure 9B:
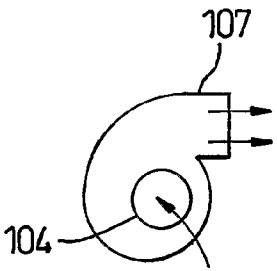
FIG. 9*b* is a schematic sectional side view of the motor arrangement of FIG. 9*a.*
Figure 9A:
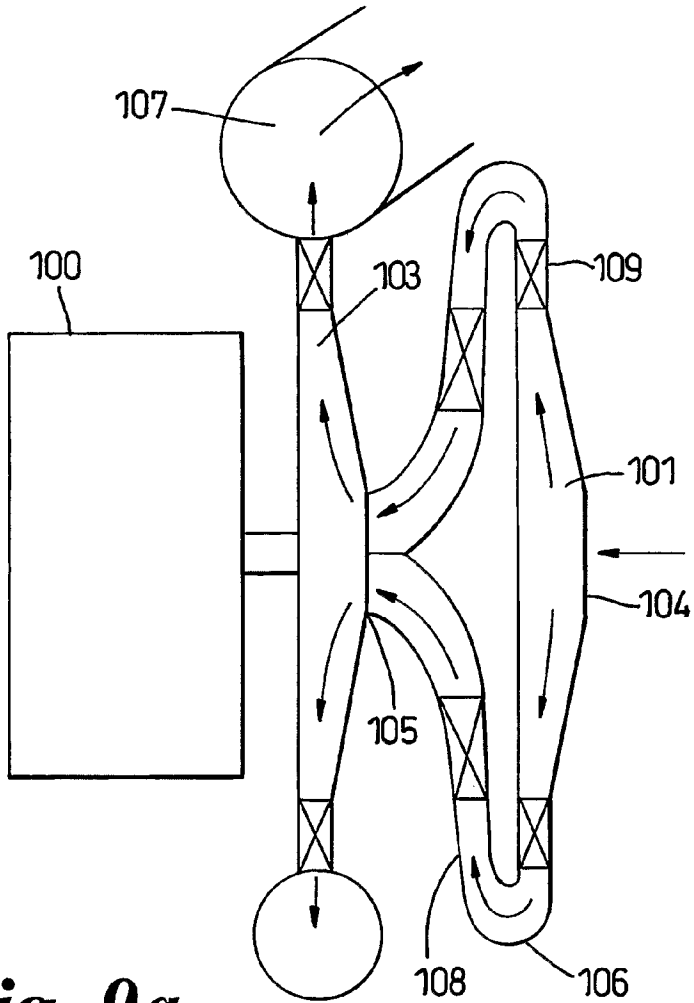
FIG. 9*a* is a schematic sectional front view, viewed from direction Y of FIG. 2, of a motor arrangement for a hand dryer according to a fourth embodiment of the invention.

In a further alternative embodiment shown in FIGS. 9*a* and 9*b* the high pressure airflows are generated with a second, alternative motor and fan arrangement. The arrows shown in FIGS. 9*a* and 9*b* represent the airflows through the motor arrangement. Motor 100 and fans 101 and 103, driven by motor 100, are located inside the casing 12. As shown in FIG. 9*a* fan 101 and fan 103 are driven in series by motor 100. Motor 100 is connected to the electrical connection and is controlled by a controller. The motor 100 may be an AC motor or a brushless switched-reluctance motor. The inlet 104, 105 of each fan 101, 103 communicates with an air inlet 44 (not shown) formed in the casing 12. The outlet 106, 107 of each fan 101, 103 is in the form of a scroll or collector. Outlet 106 communicates with a return bend or scroll 108 which communicates with inlet 105. The outlet 107 communicates with a pair of air ducts 50, 52 which are located inside the casing 12. A diffuser element 99 is provided in outlet scrolls 106, 107 to increase the airflow pressure.

The motor 100 and fan 101, 103 arrangement described above operates in the following manner. As in the first embodiment, when a user's hands are first inserted into the cavity 30 through the cavity entrance 32, the sensors 64 detect the presence of the user's hands and send a signal to motor 100 to drive the fans 101, 103. The motor 100 has a rotor which is then driven at a speed, of approximately 30,000 to 40,000 rpm, or alternatively at speeds up to 80,000 rpm or 100,000 rpm. Each fan 101, 103 is thus rotated at a similar speed and air is drawn into the hand dryer 10 via the air inlet 44 at a rate of approximately 20 to 40 litres per second. The arrangement of the fans in series creates a high pressure airflow, even with a low speed motor. The air passes along fan inlet 104 to the fan 101, the air leaving fan 101 is collected at outlet 106. The airflow leaving outlet 106 is returned to inlet 105 along return bend 108. The airflow from bend 108 is directed to fan inlet 105 and then to the fan 103. A diffuser element 109 is provided in outlet scrolls 106, 107 to increase the airflow pressure. The airflow leaving the outlet 107 is divided into two separate airflows; one passing along front air duct 50 to the slot-like opening 60 and the other passing along the rear air duct 52 to the slot-like opening 62.

The alternative arrangements shown in FIGS. 8*a*, 8*b*, 9*a* and 9*b* provide fan apparatus capable of generating a high pressure airflow with a particularly effective level of momentum emitted through the opening. The arrangements of motors and fans, including different types of fan, for example a compressor fan and one or more impellers could be altered without departing from the essence of the present invention. Other elements could also be altered such as the number of fans, the shape of fan and also the fan outlets and the shape of the collectors could be altered.

The invention is not intended to be limited to the precise detail of the embodiments described above. Modifications and variations to the detail which do not alter the scope of the invention will be apparent to a skilled reader. For example, the shape of the cavity 30 and its entrance 32 may be altered without departing from the essence of the present invention. Also, the slot-like openings described above may be replaced by lines of individual nozzles, each of which emits a jet of air towards the object placed within the cavity.

The invention claimed is:

1. A drying apparatus, comprising a casing, a cavity formed in the casing for receiving an object, a fan located in the casing and creating an airflow, a motor arranged to drive the fan, and at least one slot-like opening communicating with the fan and arranged in the casing so as to direct an airflow transversely across the cavity, wherein, in use, the pressure of the airflow emitted through the slot-like opening is at least 8 kPa, wherein the width of the slot-like opening is no more than 0.7 mm, and wherein the drying apparatus is a hand dryer.

2. The drying apparatus as claimed in claim 1, wherein the motor has a rotor which, in use, rotates at a speed of at least 80,000 rpm.

3. The drying apparatus as claimed in claim 1 or 2, wherein the motor has a rotor which, in use, rotates at a speed of at least 100,000 rpm.

4. The drying apparatus as claimed in claim 1, 2 or 3, wherein the motor is a switched-reluctance motor.

5. The drying apparatus as claimed in claim 1, wherein the fan is a two stage fan, the motor being arranged to drive the first and second stages in parallel.

6. The drying apparatus as claimed in claim 1, the motor comprising a first and a second motor and the fan comprising a first fan and a second fan, the first motor arranged to drive the first fan and the second motor arranged to drive the second fan, wherein the first and second motors are arranged to drive the first and second fans in series.

7. The drying apparatus as claimed in claim 1, 2, 3 or 6, wherein the at least one slot-like opening comprises a pair of opposed slot-like openings arranged to direct an airflow across the cavity.

8. The drying apparatus as claimed in claim 7, wherein the width of each slot-like opening is no more than 0.5 mm.

9. The drying apparatus as claimed in claim 8, wherein, in use, the velocity of the airflow emitted through the slot-like opening is at least 100 m/s.

10. The drying apparatus as claimed in claim 1, 2, 3 or 6, wherein, in use, the pressure of the airflow emitted through the slot-like opening is at least 15 kPa.

11. The drying apparatus as claimed in claim 1, 2, 3 or 6, wherein, in use, the pressure of the airflow emitted through the slot-like opening is at least 20 kPa.

* * * * *